US008015988B2

(12) United States Patent
Li

(10) Patent No.: US 8,015,988 B2
(45) Date of Patent: Sep. 13, 2011

(54) RECHARGEABLE BATTERY ARRANGEMENT FOR ELECTRICAL SYSTEM OF SHADING DEVICE

(76) Inventor: Wanda Ying Li, Santa Ana, CA (US)

( * ) Notice: Subject to any disclaimer, the term of this patent is extended or adjusted under 35 U.S.C. 154(b) by 737 days.

(21) Appl. No.: 11/985,415

(22) Filed: Nov. 14, 2007

(65) Prior Publication Data

US 2009/0120476 A1 May 14, 2009

(51) Int. Cl.
*A45B 3/02* (2006.01)

(52) U.S. Cl. ..... 135/16; 135/21; 135/910; 362/102

(58) Field of Classification Search ..... 135/16, 135/20.3, 21, 98, 910, 155; 362/102; 320/111
See application file for complete search history.

(56) References Cited

U.S. PATENT DOCUMENTS 5,152,495 A * 10/1992 Jacinto et al. ..... 248/545
5,902,080 A * 5/1999 Kopras ..... 409/182
6,039,062 A * 3/2000 Karakaedos ..... 135/16
6,612,713 B1 * 9/2003 Kuelbs ..... 362/102
6,732,752 B2 * 5/2004 Cohen et al. ..... 135/16
6,796,318 B2 * 9/2004 Cohen et al. ..... 135/16
6,966,667 B2 * 11/2005 Li ..... 362/102
7,017,598 B2 * 3/2006 Nipke ..... 135/16
7,111,954 B1 * 9/2006 Lai ..... 362/102
7,125,133 B2 * 10/2006 Bilotti et al. ..... 362/102
7,134,762 B2 * 11/2006 Ma ..... 362/102
7,188,633 B2 * 3/2007 Zerillo ..... 135/20.3
7,331,684 B2 * 2/2008 Tung ..... 362/102
7,431,469 B2 * 10/2008 Li ..... 362/102

* cited by examiner

*Primary Examiner* — Winnie Yip
(74) *Attorney, Agent, or Firm* — Raymond Y. Chan; David and Raymond Patent Firm

(57) ABSTRACT

A rechargeable power source, which is detachably coupled with a shading device to electrically connect with an electrical arrangement thereof, includes a rechargeable battery unit having a battery terminal arranged to contact with the electrical terminal of the electrical arrangement, and a locking arrangement which contains a releasable locker to detachably couple the rechargeable battery unit with the shading device and to ensure the battery terminal being contact with an electrical terminal of the electrical arrangement so as to electrically connect the rechargeable battery unit with the electrical arrangement. Therefore, the electrical arrangement of the shading device is powered by the rechargeable battery unit to eliminate the power extension to the external power source.

20 Claims, 11 Drawing Sheets

RECHARGEABLE BATTERY ARRANGEMENT FOR ELECTRICAL SYSTEM OF SHADING DEVICE

BACKGROUND OF THE PRESENT INVENTION

1. Field of Invention

The present invention relates to a shading device, and more particularly to a shading device, such as an outdoor umbrella, with rechargeable battery arrangement which is detachably mounted to the structure of the shading device to electrically connect with an electrical arrangement thereof so as to provide electrical energy to electrical arrangement, such as an audio/video system or an illumination system.

2. Description of Related Arts

Foldable outdoor umbrellas are usually set up in outdoor area, such as the patio area, garden area, campground or beach area, to provide a shade for the users to avoid excessive exposure of vigorous sunlight. A conventional outdoor umbrella generally comprises a stand having a predetermined weight, a supporting stem upwardly extending from the stand and a foldable awning supported by the supporting frame to provide a shading area under the foldable awning.

While enjoying the shading area during the daytime, people may need some entertainment equipment such as stereo or other electronic devices to listen to the music, watch videos or play video games, and the power source is a problem under the circumstances. Furthermore, in the nighttime, a lighting fixture is necessary for outdoor illumination and the power source becomes a more serious problem than that during the daytime. In other words, the outdoor umbrellas, as the name implies, are designed for use in outdoors, existence of an electrical power source cannot be guaranteed. Also, it is inconvenient and impractical for the user to extend an electrical cord from the dwelling to the patio or garden area, much less the campground or beach area.

Some outdoor umbrellas have a solar energy arrangement which can convert the solar energy to electrical energy which can be used for either the lighting fixture or electronic devices. Even though the solar energy arrangement is convenient and environmentally friendly, it may not provide sufficient energy during the nighttime without sunlight or when there is not enough sunlight, and the lighting fixture or electronic devices may not under their best working condition without sufficient electrical energy. Also, the solar energy arrangement may somewhat decrease the aesthetic value of the outdoor umbrella.

SUMMARY OF THE PRESENT INVENTION

A main object of the present invention is to provide a rechargeable battery arrangement for a shading device, wherein the rechargeable battery arrangement is detachably mounted to the structure of the shading device to electrically connect with an electrical arrangement thereof so as to provide electrical energy to electrical arrangement, such as an audio/video system or an illumination system.

Another object of the present invention is to provide a rechargeable battery arrangement for a shading device, wherein the electrical arrangement is coupled with the awning frame and an electrical terminal is extended from the electrical device to the supporting shaft in a pre-wiring manner. Therefore, the user is able to attach the rechargeable battery arrangement to the shading device to direct connect with the electrical arrangement of the shading device.

Another object of the present invention is to provide a rechargeable battery arrangement for a shading device, wherein the rechargeable battery arrangement is detachably mounted on an operation housing of the shading device, wherein the battery unit can be conveniently detached and recharged by using an external electrical power source.

Another object of the present invention is to provide a rechargeable battery arrangement for a shading device, wherein the battery unit of the rechargeable battery arrangement can be disengaged from the supporting shaft by pressing a releasing button located on the operation housing. Therefore, the user is able to easily and quickly operate the attaching/detaching operation of the rechargeable battery arrangement.

Another object of the present invention is to provide a rechargeable battery arrangement for a shading device, wherein the battery unit of the rechargeable battery arrangement can be disengaged from the supporting shaft by pressing a releasing button located on the battery unit.

Another object of the present invention is to provide a rechargeable battery arrangement for a shading device, wherein the battery unit of the rechargeable battery arrangement can be disengaged from the supporting shaft by sliding a releasing button towards one direction.

Another object of the present invention is to provide a rechargeable battery arrangement for a shading device, wherein the battery unit of the rechargeable battery arrangement can be mounted on the supporting shaft by a plurality of mounting screws.

Another object of the present invention is to provide a rechargeable battery arrangement for a shading device, which does not require altering the original structural configuration of the shading device so as to reduce the manufacturing cost of the shading device incorporating with the rechargeable battery arrangement.

Another object of the present invention is to provide a rechargeable battery arrangement for a shading device, wherein no expensive or mechanical structure is required to employ in the present invention in order to achieve the above mentioned objects. Therefore, the present invention successfully provides an economic and efficient solution not only for providing a simple electrical configuration of the outdoor umbrella but also for enhancing the practice use of the shading device.

Accordingly, in order to accomplish the above objects, the present invention provides a shading device, which comprises an awning, a frame, an electrical arrangement, and a rechargeable power source.

The frame comprises a supporting shaft and an awning frame suspendedly supported by the supporting shaft and coupled with the awning for defining a shading area thereunder.

The electrical arrangement is supported at the frame for providing an additional shading function, wherein the electrical arrangement comprises an electrical device coupled with the awning frame and an electrical terminal extended from the electrical device to the supporting shaft in a pre-wiring manner.

The rechargeable power source comprises:

a rechargeable battery unit having a power outlet for electrically connecting with an external power source in charging manner, and a battery terminal arranged to contact with the electrical terminal of said electrical arrangement; and a locking arrangement which contains a releasable locker to detachably couple the rechargeable battery unit with the frame at a hand reachable distance and to ensure the battery terminal being contact with the electrical terminal so as to electrically connect the rechargeable battery unit with the electrical arrangement.

These and other objectives, features, and advantages of the present invention will become apparent from the following detailed description, the accompanying drawings, and the appended claims.

DETAILED DESCRIPTION OF THE PREFERRED EMBODIMENT

Figure 1:
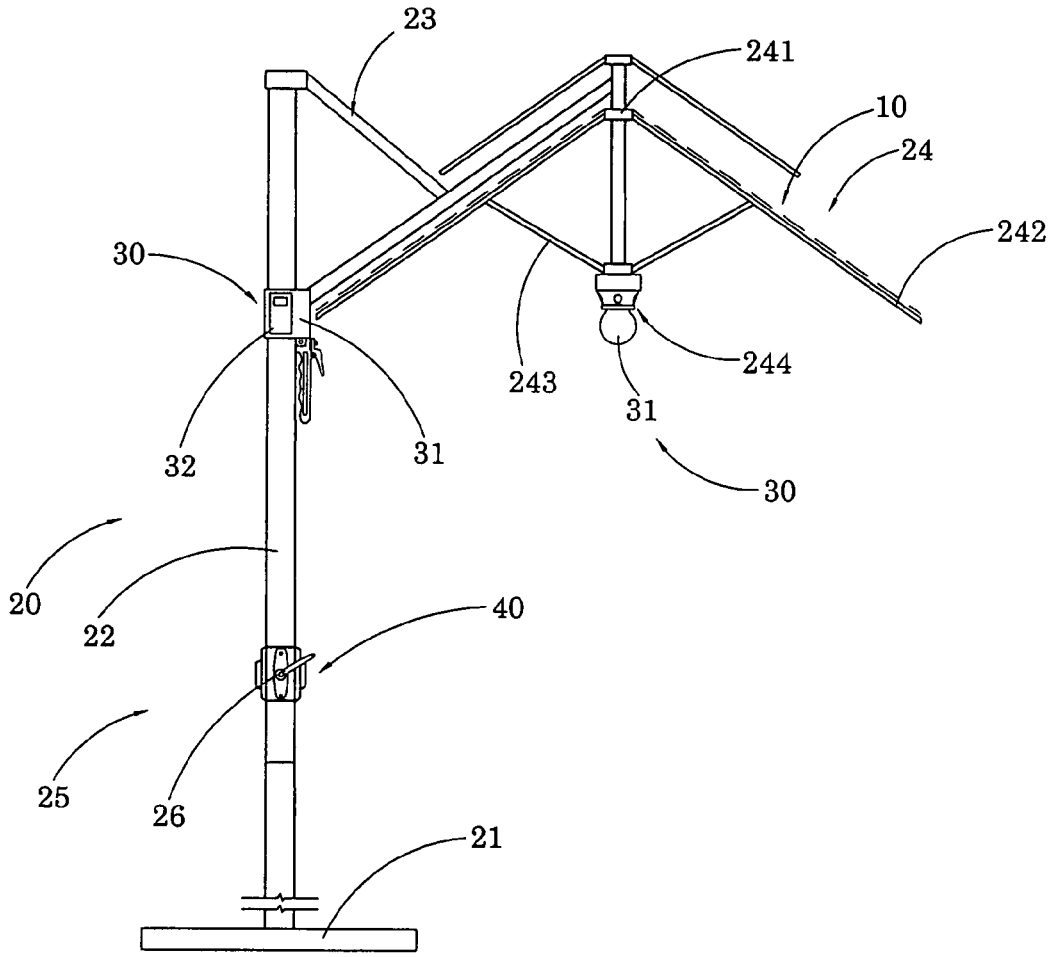
FIG. 1 is a schematic representation of an outdoor umbrella incorporating with the rechargeable battery arrangement according to the preferred embodiment of the present invention.

Referring to FIG. 1 of the drawings, a shading device according to a first preferred embodiment of the present invention is illustrated. According to the first preferred embodiment, the shading device comprises an awning supported by an awning supporting structure to provide a shading area under the awning. For example, the shading device, which is embodied as an outdoor umbrella, comprises an umbrella awning 10, an umbrella frame 20 which supports the umbrella awning 10, an electrical arrangement 30 supported at the umbrella frame 20, and a rechargeable power source 40 which provides electrical power to the electrical arrangement 30 to be operated without using an electrical cord.

The umbrella frame 20 comprises a base 21, a supporting shaft 22 vertically mounted on top of the base 21, a connecting arm 23 sidewardly extended from a top portion of the supporting shaft 22 in a pivotally movable manner, and a foldable awning frame 24 suspendedly supported by the supporting shaft 22 and coupled with the umbrella awning 10 to define the shading area under the umbrella awning 10.

As shown in FIG. 1 and FIG. 2, the umbrella frame 20 further comprises an operation housing 25 mounted at the supporting shaft 22, an operational unit 26 and a battery compartment 27, wherein the operation unit 26 is adapted for selectively operating the awning frame 24 at an unfolded position and a folded position. The battery compartment 27 is provided at a sidewall of the operation housing 25 to receive a battery unit 41 illustrated below.

The awning frame 24 comprises an upper housing 241 and a plurality of awning supporting arms 242 outwardly and radially extended from the upper housing 241 in such a manner that they are adapted to move between a folded position and an unfolded position, wherein in the folded position, the awning supporting arms 242 are pivotally and inwardly folded to overlappedly lay in position, wherein in the unfolded position, the awning supporting arms 242 are pivotally and outwardly extended to support the umbrella awning 10 thereon and to define a shading area under the awning supporting arms 242. The awning frame 24 further comprises a plurality of lower connecting bars 243 each having a first end slidably mounted on the awning supporting arms 242, and a second end mounted on a lower housing 244 provided below the upper housing 241.

The electrical arrangement 30 comprises at least one electrical device 31 such as a music player, a movie player or a lighting fixture, supported at the umbrella frame 20 to provide an additional umbrella function, wherein the electrical device 31 is coupled with the awning frame 24 and an electrical terminal 32 extended from the electrical device 31 to the supporting shaft 22 in a pre-wiring manner.

Figure 2A:
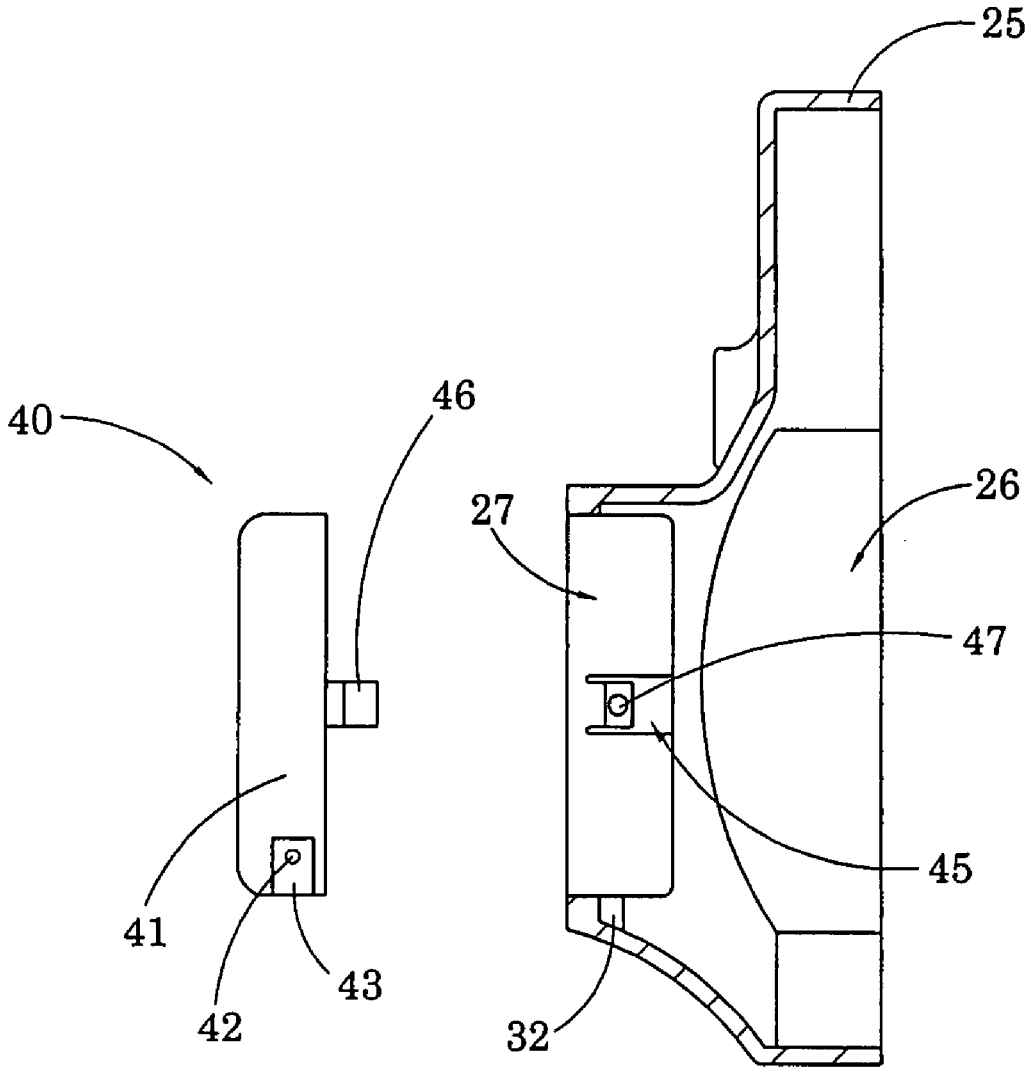
FIG. 2A is a schematic representation of the rechargeable battery arrangement of the outdoor umbrella according to the above preferred embodiment of the present invention, wherein the releasing button is located at an operation housing.
Figure 2B:
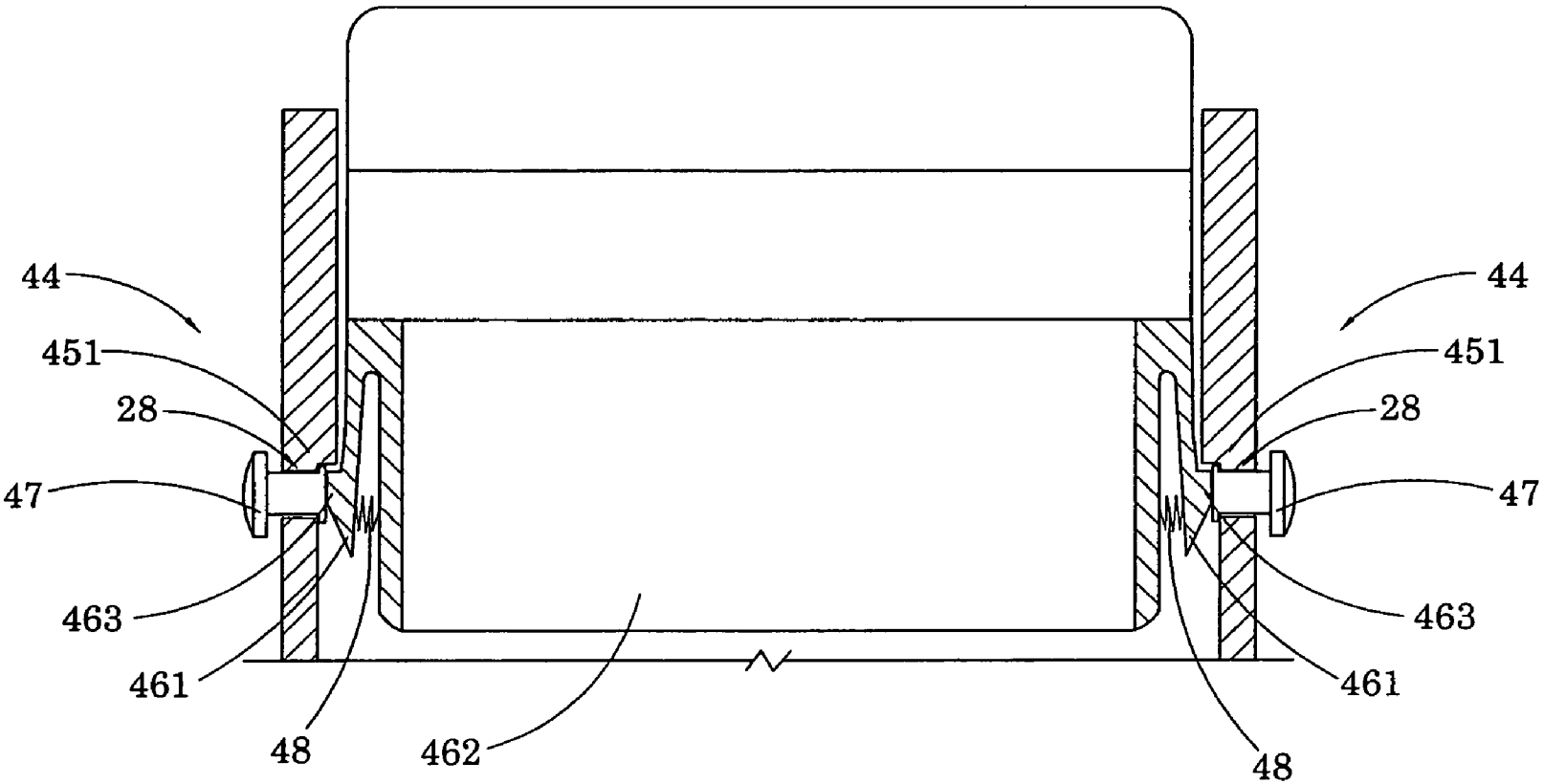
FIG. 2B is sectional view of the rechargeable battery arrangement of the outdoor umbrella according to the above preferred embodiment of the present invention.

As shown in FIG. 2A and FIG. 2B, the rechargeable power source 40 comprises a rechargeable battery unit 41 having a power outlet 42 for electrically connecting with an external power source in charging manner, and a battery terminal 43 arranged to contact with the electrical terminal 32 of the electrical arrangement 30. The rechargeable power source 40 also includes a locking arrangement 44 for retaining the rechargeable battery unit 41 at the umbrella frame 20. The locking arrangement 44 comprises a locker slot 45 provided at the umbrella frame 20 and a releasable locker 46 extended from the rechargeable battery unit 41 to detachably couple the rechargeable battery unit 41 with the supporting shaft 22 and to ensure the battery terminal 43 being contact with the electrical terminal 32 so as to electrically connect the rechargeable battery unit 41 with the electrical arrangement 30. Accordingly, the rechargeable battery unit 41 is detachably mounted at the umbrella frame 20 with a hand reachable distance such that when the user locates within the shading area of the umbrella frame 20, the user is able to reach the rechargeable battery unit 41 to attach to or detach from the umbrella frame 20.

It is worth to mention that two rechargeable power sources 40 can be detachably mounted to two sides of the operation housing 25 respectively to double the power supply for the electrical arrangement 30. In other words, two battery compartments 27 are provided at two side of the operation housing 25 to receive two rechargeable power sources 40 respectively.

Accordingly, the locker slot 45 and the electrical terminal 32 are provided at a base wall and a bottom wall of the battery compartment 27 to slidably engage with the releasable locker 46 and to electrically contact with the battery terminal 43 respectively when the rechargeable battery unit 41 is received in the battery compartment 43. In other words, the rechargeable battery unit 41 of the rechargeable power source 40 is detachably mounted at the supporting shaft 22 of the outdoor umbrella. Therefore, by detachably mounting the rechargeable battery unit 41 at the operation housing 25 mounted along the supporting shaft 22, the user is able to reach the rechargeable battery unit 41 and operate the folding/unfolding operation of the umbrella awning 10.

The releasable locker 46 comprises two spaced apart resilient arms 461 and a locking tongue 462, wherein each of the resilient arms 461 has a hooking end 463 formed at a free end thereof. The locker slot 45 has two locking protrusions 451 provided at two sidewalls of the locker slot 45, wherein the hooking ends 463 of the resilient arms 461 are engaged with the locking protrusions 451 when the releasable locker 46 is slid into the locker slot 45. Accordingly, the locking tongue 462 is slidably inserted into the locker slot 45, wherein the resilient arms 461 are spacedly extended at two sidewalls of the locking tongue 462 to define a resilient gap between each of the resilient arms 461 and the corresponding sidewall of the locking tongue 462. Each of the resilient gaps allows the respective resilient arm 461 to be slightly bent to engage with the respective locking protrusion 451 when the releasable locker 46 is slid into the locker slot 45.

In the preferred embodiment as shown in FIG. 2B, in order to disengage the rechargeable battery unit 41 from the supporting shaft 22, the locking arrangement 44 comprises two releasing buttons 47 located at corresponding actuation slots 28 on the umbrella frame 20. The releasing buttons 47 are arranged for releasing the releasable locker 46 from the locker slot 45, wherein each of the releasing buttons 47 has a pushing end aligned with the respective resilient arm 461 and an opposed pressing end arranged in such a manner that when the pressing ends of the releasing buttons 47 are pressed, the pushing ends of the releasing buttons 47 push at the resilient arms 461 towards the resilient gaps so as to disengage the hooking ends 463 of the resilient arms 461 with the locking protrusions 451 respectively.

Accordingly, the releasing buttons 47 are slidably mounted at the sidewalls of the locker slot 45 respectively at a position that the pushing ends of the releasing buttons 47 are align with the hooking ends 463 of the resilient arms 461 respectively, such that when the pressing ends of the releasing buttons 47 are pressed, the resilient arms 461 are driven to move at the resilient gaps to disengage with the locking protrusions 451 respectively. In particularly, the releasing button 47 is movably mounted to the sidewalls of the locker slot 45 through the actuation slots 28, wherein each of the actuation slots 28 is aligned with the hooking end 463 of the resilient arm 461 such that when the releasing button 47 is pressed towards the hooking end 463, the hooking end 463 is pushed away from the locking protrusion 451 to disengage the locking structure.

In addition, the locking arrangement 44 further comprises two resilient elements 48 supported within the resilient gaps respectively, wherein each of the resilient elements 48 has two ends biasing against the respective resilient arm 461 and the sidewall of the locking tongue 462 for applying an urging force against the resilient arm 461. Each of the resilient elements 48 is a compression spring for providing an additional resilient force to the respective resilient arm 461 and the respective releasing button 47 as well. In other words, the releasing button 47 is coupled with the resilient element 48 via the respective resilient arm 461, such that the releasing button 47 can be restored to its original position after being pressed towards the hooking end 463.

When the rechargeable battery unit 41 is charged and connected with the electrical arrangement 30, the electrical power to operate the electrical device 31 is provided by the rechargeable battery unit 41. In other words, the user can play music or movie through the player pre-wired to the supporting shaft 22 outside the dwelling and under the shading area defined by the umbrella awning 10 without using the electrical cord. During the nighttime, the user can further enjoy the music or movie under the outdoor umbrella 10 by lighting up the lighting fixture to which the electrical power is also provided by the rechargeable battery unit 41.

Figure 3A:
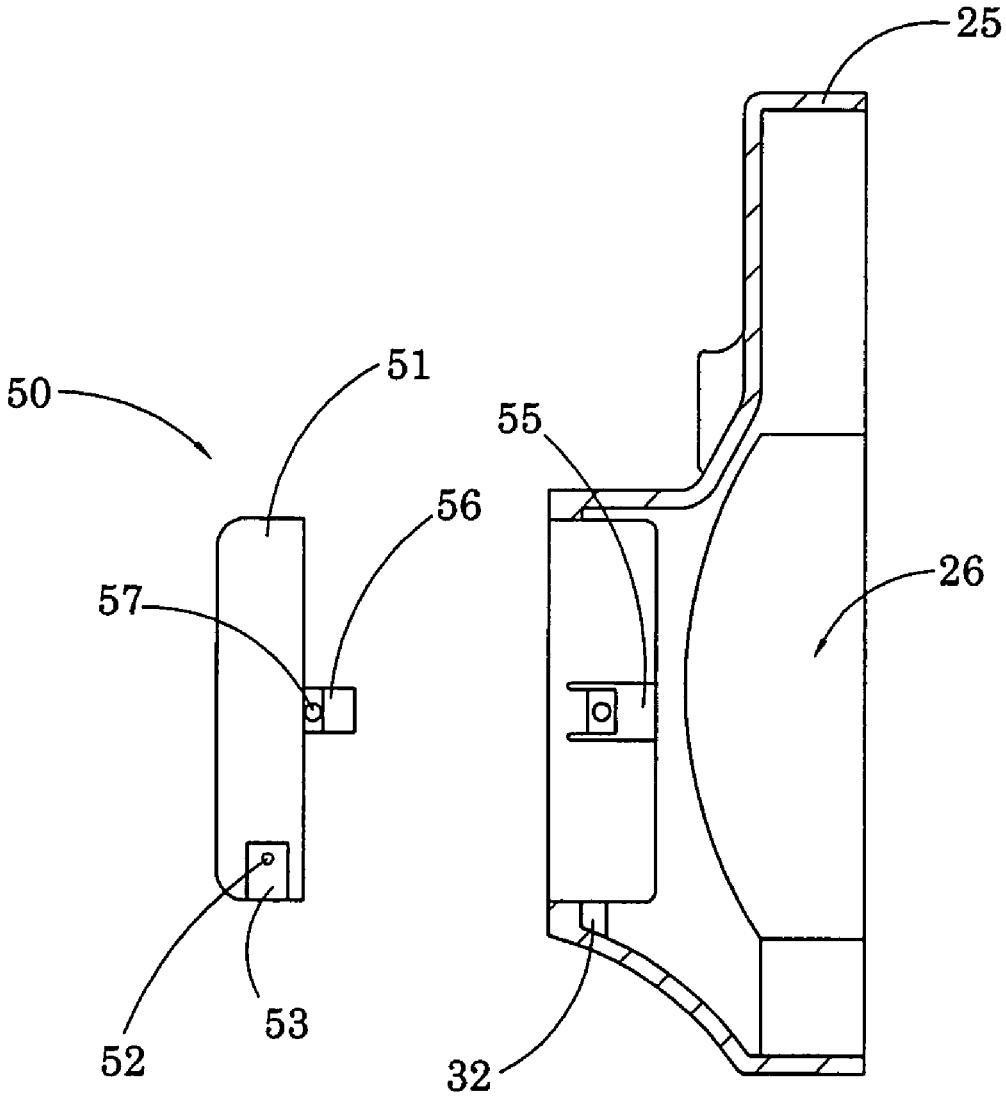
FIGS. 3A and 3B illustrate a first alternative mode of the locking arrangement according to the above preferred embodiment of the present invention, wherein the releasing button is located at a rechargeable battery unit.
Figure 3B:
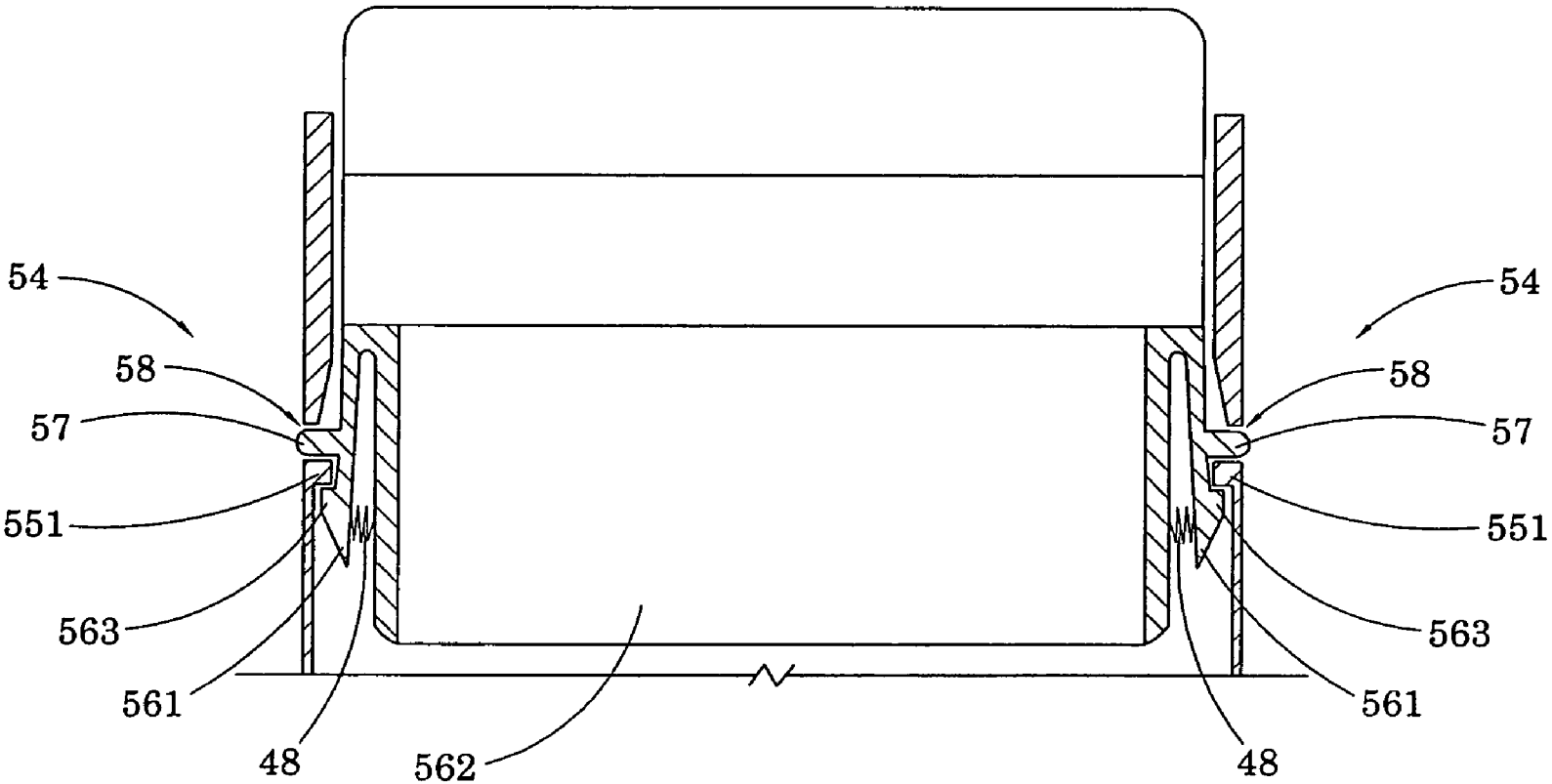

Referring to FIG. 3A and FIG. 3B of the drawings, a first alternative of the rechargeable power source 50 is illustrated. The rechargeable power source 50 comprises a rechargeable battery unit 51 having a power outlet 52 for electrically connecting with an external power source in charging manner, and a battery terminal 53 arranged to contact with the electrical terminal 32 of the electrical arrangement 30. The rechargeable power source 50 also includes a locking arrangement 54 which comprises a locker slot 55 provided at the supporting shaft 22 and a releasable locker 56 extended from the rechargeable battery unit 51 to detachably couple the rechargeable battery unit 51 with the supporting shaft 22 and to ensure the battery terminal 53 being contact with the electrical terminal 32 so as to electrically connect the rechargeable battery unit 51 with the electrical arrangement 30.

Accordingly, the locker slot 55 and the electrical terminal 32 are provided at a base wall and a bottom wall of the battery compartment 27 to slidably engage with the releasable locker 56 and to electrically contact with the battery terminal 53 respectively when the rechargeable battery unit 51 is received in the battery compartment 53.

The releasable locker 56 comprises two spaced apart resilient arms 561 and a locking tongue 562, wherein each of the resilient arms 561 has a hooking end 563 formed at a free end thereof. The locker slot 55 has two locking protrusions 551 provided at two sidewalls of the locker slot 55, wherein the hooking ends 563 of the resilient arms 561 are engaged with the locking protrusions 551 when the releasable locker 56 is slid into the locker slot 55. Accordingly, the locking tongue 562 is slidably inserted into the locker slot 55, wherein the resilient arms 561 are spacedly extended at two sidewalls of the locking tongue 562 to define a resilient gap between each of the resilient arms 561 and the corresponding sidewall of the locking tongue 562. Each of the resilient gaps allows the respective resilient arm 561 to be slightly bent to engage with the respective locking protrusion 551 when the releasable locker 56 is slid into the locker slot 55.

As shown in FIG. 3B, in order to disengage the rechargeable battery unit 51 from the supporting shaft 22, the locking arrangement 54 comprises two releasing buttons 57 aligned with corresponding actuation slots 59 on the umbrella frame 20. The releasing buttons 57 are arranged for releasing the releasable locker 56 from the locker slot 55, wherein each of the releasing buttons 57 has a pushing end aligned with the respective resilient arm 561 and an opposed pressing end arranged in such a manner that when the pressing ends of the releasing buttons 57 are pressed, the pushing ends of the releasing buttons 57 push at the resilient arms 561 towards the resilient gaps so as to disengage the hooking ends 563 of the resilient arms 561 with the locking protrusions 551 respectively.

Accordingly, the pushing ends of the two releasing buttons 57 are sidewardly and integrally extended at the resilient arms 561 respectively such that when the pressing ends of the releasing buttons 57 are pressed, the resilient arms 561 are driven to move at the resilient gaps to disengage with the locking protrusions 551 respectively.

The two actuation slots 59 are formed at the sidewalls of the locker slot 55 respectively, wherein the pressing ends of the releasing buttons 57 are protruded out of the locker slot 55 through the actuation slots 59 respectively when the releasable locker 56 is locked at the locker slot 55. Therefore, when the releasable locker 56 is slidably inserted into the locker slot 55, the pressing ends of the releasing buttons 57 slide at the sidewalls of the locker slot 55 until the pressing ends of the releasing buttons 57 are located at the actuation slots 59 respectively, so as to ensure the hooking ends 563 of the resilient arms 561 engaging with the locking protrusions 551.

The locking arrangement 54 further comprises two resilient elements 58 supported within the resilient gaps respectively, wherein each of the resilient elements 58 has two ends biasing against the respective resilient arm 561 and the sidewall of the locking tongue 562 for applying an urging force against the resilient arm 561. Each of the resilient elements 58 is a compression spring for providing an additional resilient force to the respective resilient arm 561 and the respective releasing button 57 as well. In other words, the releasing button 57 is coupled with the resilient element 58 via the respective resilient arm 561, such that the releasing button 57 can be restored to its original position after being pressed towards the hooking end 563.

Figure 4A:
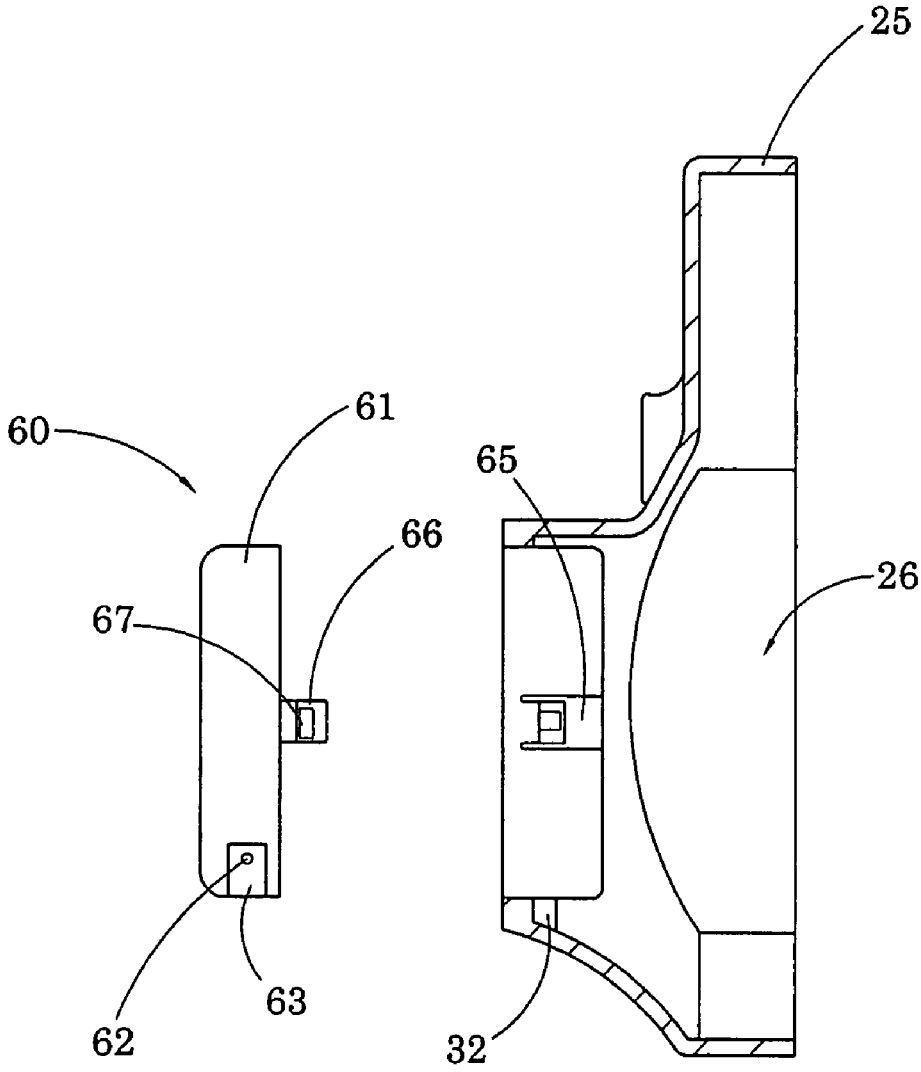
FIGS. 4A and 4B illustrate a second alternative mode of the locking arrangement according to the above preferred embodiment of the present invention, wherein the releasing button is located at the rechargeable battery unit in a slidable manner.
Figure 4B:
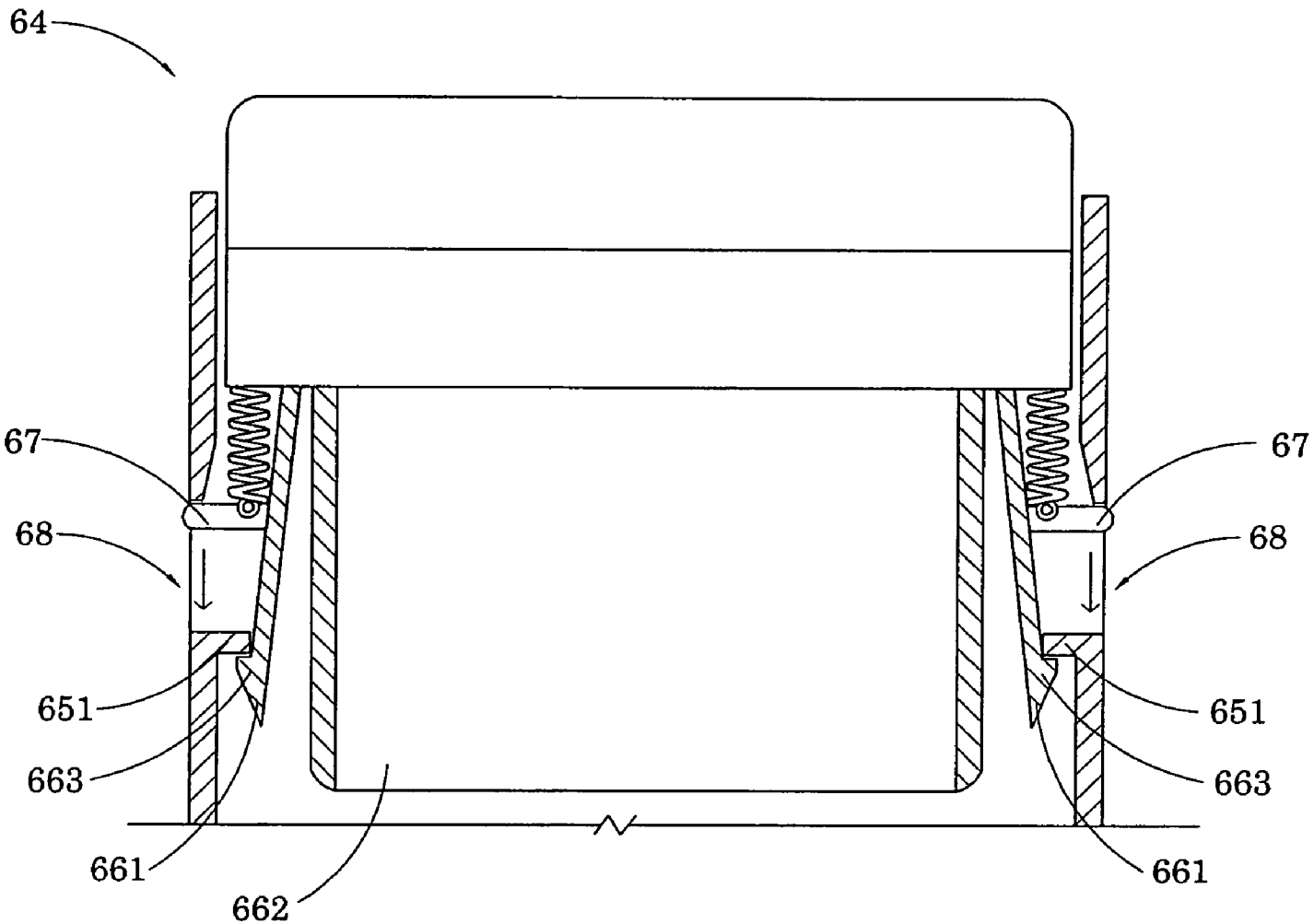

Referring to FIG. 4A and FIG. 4B of the drawings, a second alternative of the rechargeable power source 60 is illustrated. The rechargeable power source 60 comprises a rechargeable battery unit 61 having a power outlet 62 for electrically connecting with an external power source in charging manner, and a battery terminal 63 arranged to contact with the electrical terminal 32 of the electrical arrangement 30. The rechargeable power source 60 also includes a locking arrangement 64 which comprises a locker slot 65 provided at the supporting shaft 22 and a releasable locker 66 extended from the rechargeable battery unit 61 to detachably couple the rechargeable battery unit 61 with the supporting shaft 22 and to ensure the battery terminal 63 being contact with the electrical terminal 32 so as to electrically connect the rechargeable battery unit 61 with the electrical arrangement 30.

Accordingly, the locker slot 65 and the electrical terminal 62 are provided at a base wall and a bottom wall of the battery compartment 27 to slidably engage with the releasable locker 66 and to electrically contact with the battery terminal 63 respectively when the rechargeable battery unit 61 is received in the battery compartment 63.

The releasable locker 66 comprises two spaced apart resilient arms 661 and a locking tongue 662, wherein each of the resilient arms 661 has a hooking end 663 formed at a free end thereof. The locker slot 65 has two locking protrusions 651 provided at two sidewalls of the locker slot 65, wherein the hooking ends 663 of the resilient arms 661 are engaged with the locking protrusions 651 when the releasable locker 66 is slid into the locker slot 65. Accordingly, the locking tongue 662 is slidably inserted into the locker slot 65, wherein the resilient arms 661 are spacedly extended at two sidewalls of the locking tongue 662 to define a resilient gap between each of the resilient arms 661 and the corresponding sidewall of the locking tongue 662. Each of the resilient gaps allows the respective resilient arm 661 to be slightly bent to engage with the respective locking protrusion 651 when the releasable locker 66 is slid into the locker slot 65.

As shown in FIG. 4B, in order to disengage the rechargeable battery unit 61 from the supporting shaft 22, the locking arrangement 64 comprises two releasing buttons 67 aligned with corresponding actuation slots 69 on the umbrella frame 20. The releasing buttons 67 are arranged for releasing the releasable locker 66 from the locker slot 65, wherein each of the releasing buttons 67 has a pushing end aligned with the respective resilient arm 661 and an opposed pressing end arranged in such a manner that when the pressing ends of the releasing buttons 67 are pressed, the pushing ends of the releasing buttons 67 push at the resilient arms 661 towards the resilient gaps so as to disengage the hooking ends 663 of the resilient arms 661 with the locking protrusions 651 respectively.

Accordingly, the pushing ends of the two releasing buttons 67 are slidably mounted at the resilient arms 661 respectively such that when the pressing ends of the releasing buttons 67 are pressed to slide along the resilient arms 661 respectively, the resilient arms 661 are driven to move at the resilient gaps to disengage with the locking protrusions 651 respectively. In other words, when the releasing buttons 67 are pressed and slid towards the hooking ends 663 of the resilient arms 661 respectively, the hooking ends 663 of the resilient arms 661 are pressed towards the resilient gaps to disengage with the locking protrusions 651 respectively.

The two actuation slots 69 are formed at the sidewalls of the locker slot 65 respectively, wherein the pressing ends of the releasing buttons 67 are protruded out of the locker slot 65 through the actuation slots 69 respectively when the releasable locker 66 is locked at the locker slot 65. Therefore, when the releasable locker 66 is slidably inserted into the locker slot 65, the pressing ends of the releasing buttons 67 slide at the sidewalls of the locker slot 65 until the pressing ends of the releasing buttons 67 are located at the actuation slots 69 respectively, so as to ensure the hooking ends 663 of the resilient arms 661 engaging with the locking protrusions 651.

The locking arrangement 64 further comprises two resilient elements 68 coupled with the releasing buttons 67 to slidably pull the releasing buttons 67 away from the hooking end 663 of the resilient arms 661. Each of the resilient elements 68 has two ends coupling with the base wall of the releasable locker 66 and the releasing buttons 67 for applying a pulling force against the releasable locker 66 such that the releasing button 67 can be restored to its original position after being pressed towards the hooking end 663.

Figure 5:
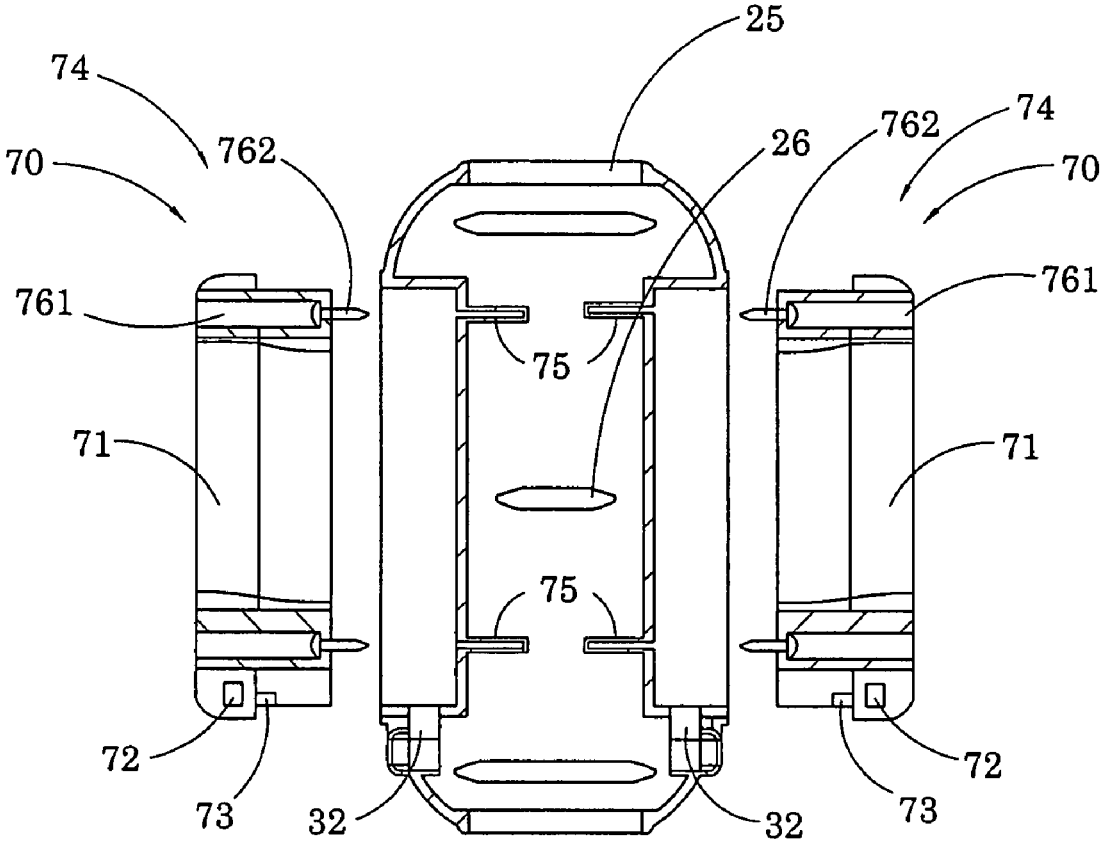
FIG. 5 illustrates a third alternative mode of the locking arrangement according to the above preferred embodiment of the present invention, wherein the rechargeable battery unit is securely fastened by a plurality of mounting screws.

Referring to FIG. 5 of the drawings, a third alternative of the rechargeable power source 70 is illustrated. The rechargeable power source 70 comprises a rechargeable battery unit 71 having a power outlet 72 for electrically connecting with an external power source in charging manner, and a battery terminal 73 arranged to contact with the electrical terminal 32 of the electrical arrangement 30. The rechargeable power source 70 also includes a locking arrangement 74 which comprises a locker slot 75 provided at the supporting shaft 22 and a releasable locker 76 extended from the rechargeable battery unit 71 to detachably couple the rechargeable battery unit 71 with the supporting shaft 22 and to ensure the battery terminal 73 being contact with the electrical terminal 32 so as to electrically connect the rechargeable battery unit 71 with the electrical arrangement 30.

The releasable locker 76 contains a mounting slot 761 aligned with the locker slot 75 when the rechargeable battery unit 71 is disposed in the battery compartment 27 and comprises a mounting screw 762 detachably engaging with said locker slot 75 through the mounting slot 761 to detachably mount the rechargeable battery unit to the battery compartment 27 so as to ensure the battery terminal 73 being contact with the electrical terminal 32.

Figure 6:
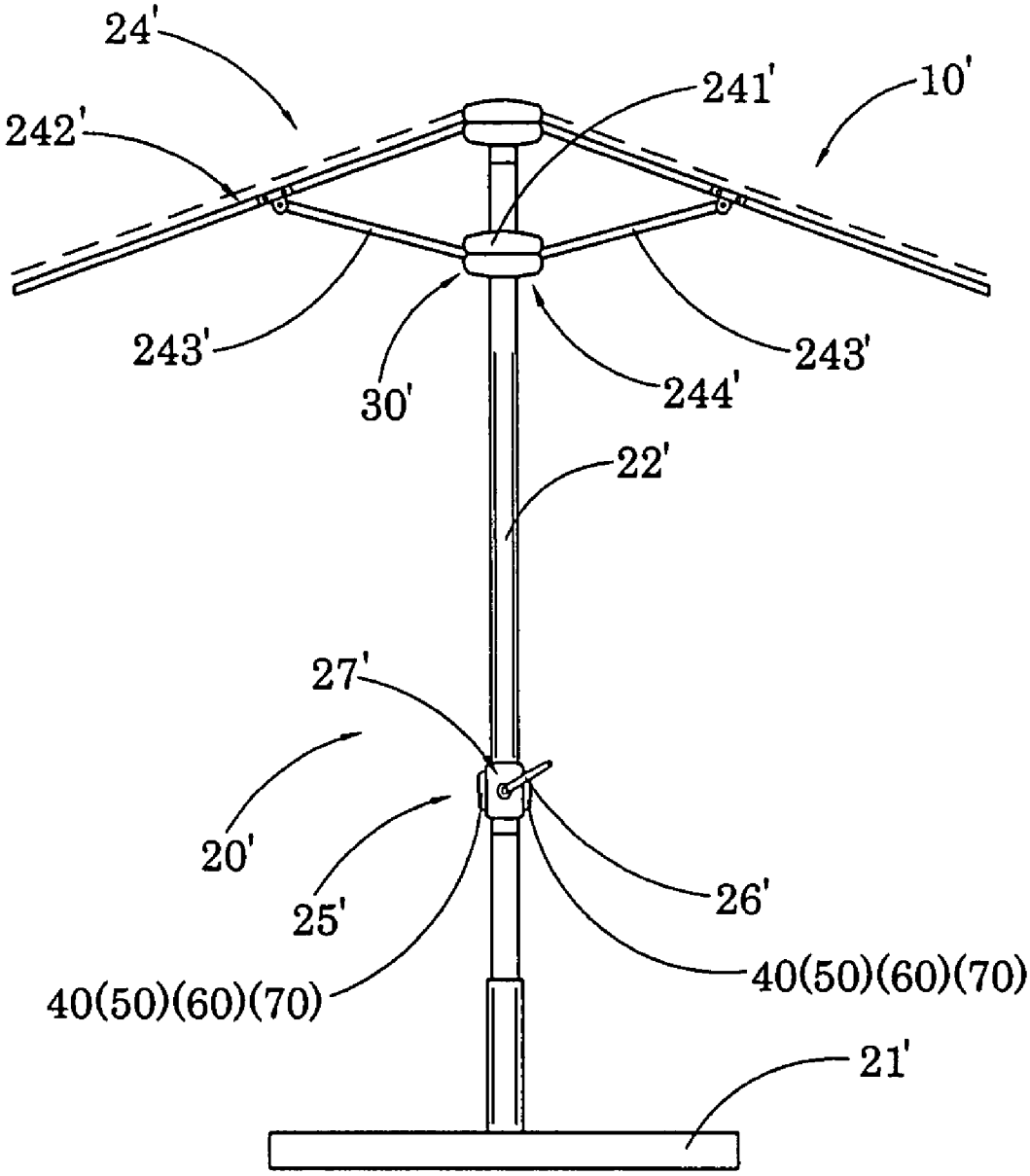
FIG. 6 illustrates an alternative mode of the umbrella frame in which above mentioned locking arrangements can be installed.

Referring to FIG. 6 of the drawings, the rechargeable power source 40 and its alternatives 50, 60, 70 of the present invention can be incorporated with another type of outdoor umbrella to electrically connect to the electrical arrangement 30' thereof without using an electrical cord.

The umbrella frame 20' comprises a base 21', a supporting shaft 22' vertically mounted on top of the base 21' and a foldable awning frame 24' suspendedly supported by the supporting shaft 22' and coupled with the umbrella awning 10' to define a shading area.

As shown in FIG. 6, the umbrella frame 20' further comprises an operation housing 25', an operational unit 26' and a battery compartment 27', wherein the operation unit 26' is adapted for selectively operating the awning frame 24' at an unfolded position and a folded position. The battery compartment 27' is provided at a sidewall of the operation housing 25'.

The awning frame 24' comprises an upper housing 241' and a plurality of awning supporting arms 242' outwardly and radially extended from the upper housing 241' in such a manner that they are adapted to move between a folded position and an unfolded position, wherein in the folded position, the awning supporting arms 242' are pivotally and inwardly folded to overlappedly lay in position, wherein in the unfolded position, the awning supporting arms 242' are pivotally and outwardly extended to support the umbrella awning 10' thereon and to define a shading area under the awning supporting arms 242'. The awning frame 24' further comprises a pair of lower connecting bars 243' each having a first end slidably mounted on the awning supporting arms 242', and a second end mounted on a lower housing 244' provided below the upper housing 241'.

The electrical arrangement 30' is embodied as a speaker supported at the lower housing 244' of the awning frame 24', wherein the electrical arrangement 30' is pre-wired that the electrical terminal is provided at the battery compartment 27'. Therefore, the rechargeable power source 40, 50, 60, 70, is detachably coupled at the operation housing 25' to electrically connect with the electrical arrangement 30'.

Figure 7:
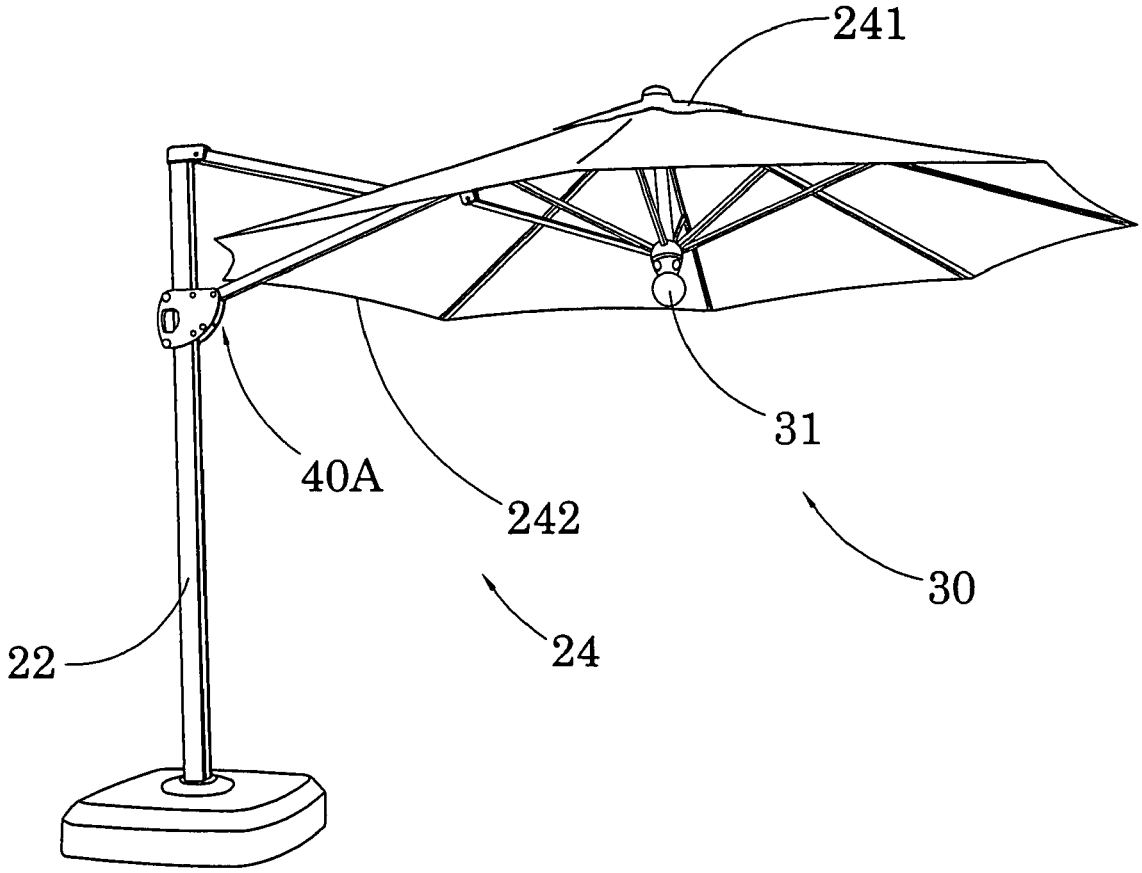
FIG. 7 is a perspective view of an outdoor umbrella with a rechargeable battery arrangement according to a second preferred embodiment of the present invention.
Figure 8:
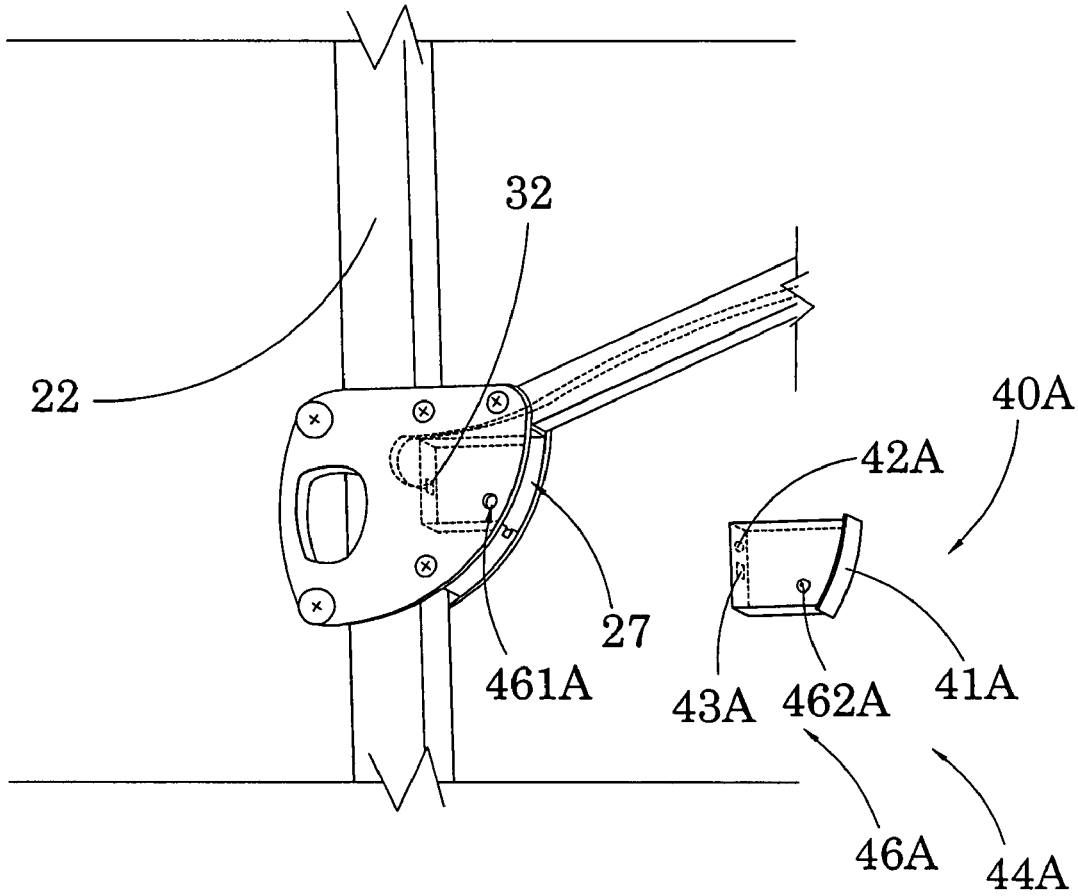
FIG. 8 is an exploded perspective view of the rechargeable battery arrangement for the outdoor umbrella according to the above second preferred embodiment of the present invention.

FIGS. 7 and 8 illustrate an alternative mode of the rechargeable power source 40A. The rechargeable power source 40A comprises a rechargeable battery unit 41A having a power outlet 42A for electrically connecting with an external power source in charging manner, and a battery terminal 43A arranged to contact with the electrical terminal 32 of the electrical arrangement 30. The rechargeable power source 40A also includes a locking arrangement 44A for retaining the rechargeable battery unit 41A at the umbrella frame 20. The locking arrangement 44A comprises a releasable locker 46A to detachably couple the rechargeable battery unit 41A with the supporting shaft 22 and to ensure the battery terminal 43A being contact with the electrical terminal 32 so as to electrically connect the rechargeable battery unit 41A with the electrical arrangement 30.

As shown in FIG. 7, the electrical terminal 32 is provided at the foldable awning frame 24 to engage with the releasable locker 46A and to electrically contact with the battery terminal 43A respectively when the rechargeable battery unit 41A is mounted at foldable awning frame 24.

As it is mentioned above, the awning frame 24 comprises an upper housing 241 and a plurality of awning supporting arms 242. The rechargeable battery unit 41A is detachably mounted at one of the awning supporting arms 242 which is pivotally and slidably connected to the supporting shaft 22. Accordingly, the respective awning supporting arm 242 has a first end slidably coupled at the supporting shaft 22 and a second end pivotally coupled at the upper housing 241. A battery compartment 27 is provided at the first end of the awning supporting arm 242 for the rechargeable battery unit 41A receiving in the battery compartment 27. As shown in FIG. 8, the first end of the awning supporting arm 242 forms a coupling joint to slidably engage with the supporting shaft 22 and to allow the awning supporting arm 242 to pivotally move with respect to the supporting shaft 22. It is worth to mention that the electrical device 31 is electrically coupled with the electrical terminal 32 in a pre-wiring manner, wherein the electric cable is extended through the respective awning supporting arm 242 to electrically couple between the electrical device 31 and the electrical terminal 32 such that the pivotal movement of the awning frame 24 will not affect the electrical connection of the electrical device 31. Thus, the user is able to reach the rechargeable battery unit 41A when the user locates within the shading area of the outdoor umbrella.

As shown in FIG. 8, the releasable locker 46A contains a through locker slot 461A provided at one of the sidewall of the battery compartment 27 and a locking protrusion 462A which is retractably extended from the rechargeable battery unit 41A and is arranged in such a manner that when the rechargeable battery unit 41A is received at the battery compartment 27, the locking protrusion 462A is engaged with the locker slot 461A to lock up the rechargeable battery unit 41A at the umbrella frame 20 to ensure the battery terminal 43A being contact with the electrical terminal 32 so as to electrically connect the rechargeable battery unit 41A with the electrical arrangement 30. Therefore, when the awning frame 24 is pivotally moved to fold or unfold the umbrella awning 10, the rechargeable battery unit 41A is correspondingly moved without disconnecting the connection between the rechargeable battery unit 41A and the electrical device 30.

In order to detach the rechargeable battery unit 41A from the battery compartment 27, the user is able to apply an inward pushing force at a free end of the locking protrusion 462A to disengage the locking protrusion 462A from the locker slot 461A so as to remove the rechargeable battery unit 41A from the outdoor umbrella.

As it is mentioned above, the shading device can be a canopy which comprises a canopy awning supported by a canopy supporting frame, wherein the canopy supporting frame comprises an awning supporting frame and a plurality of canopy supporting shafts. The rechargeable power source of the present invention can be provided at either the awning supporting frame or one of the canopy supporting shafts, wherein the electrical device is provided at the awning supporting frame to electrically couple with the rechargeable power source.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor umbrella, comprising:

an umbrella awning;

an umbrella frame comprising a supporting shaft and an awning frame suspendedly supported by said supporting shaft and coupled with said umbrella awning for defining a shading area thereunder;

an electrical arrangement supported at said umbrella frame for providing an additional umbrella function, wherein said electrical arrangement comprises an electrical device coupled with said awning frame and an electrical terminal extended from said electrical device to said supporting shaft in a pre-wiring manner; and a rechargeable power source, comprising:

a rechargeable battery unit having a power outlet for electrically connecting with an external power source in charging manner, and a battery terminal arranged to contact with said electrical terminal of said electrical arrangement; and a locking arrangement which contains a locker slot provided at a housing positioned on said supporting shaft of said umbrella frame at a hand reachable distance and a releasable locker extended from said rechargeable battery unit to detachably couple said rechargeable battery unit with said umbrella frame and to ensure said battery terminal being contact with said electrical terminal so as to electrically connect said rechargeable battery unit with said electrical arrangement.

2. The outdoor umbrella, as recited in claim 1, wherein said releasable locker comprises two spaced apart resilient arms slidably engaging with said locker slot, wherein two locking protrusions are provided at two sidewalls of said locker slot to engage with hooking ends of said resilient arms when said releasable locker is slid into said locker slot.

3. The outdoor umbrella, as recited in claim 2, wherein said releasable locker further comprises a locking tongue slidably inserted into said locker slot, wherein said resilient arms are spacedly extended at two sidewalls of said locking tongue to define a resilient gap between each of said resilient arms and said corresponding sidewall of said locking tongue, wherein each of said resilient gaps allows said respective resilient arm to be slightly bent to engage with said respective locking protrusion when said releasable locker is slid into said locker slot.

4. The outdoor umbrella, as recited in claim 3, wherein said housing is an operation housing mounted at said supporting shaft, said umbrella frame further comprises an operational unit received at said operation housing for selectively operating said awning frame at an unfolded position and a folded position, and a battery compartment provided at a sidewall of said operation housing to receive said rechargeable battery unit, wherein said locker slot and said electrical terminal are provided at a base wall and a bottom wall of said battery compartment to slidably engage with said releasable locker and to electrically contact with said battery terminal respectively when said rechargeable battery unit is received in said battery compartment.

5. The outdoor umbrella, as recited in claim 4, wherein said releasable locker contains a mounting slot aligned with said locker slot when said rechargeable battery unit is disposed in said battery compartment and comprises a mounting screw detachably engaging with said locker slot through said mounting slot to detachably mount said rechargeable battery unit to said battery compartment.

6. The outdoor umbrella, as recited in claim 4, wherein said locking arrangement further comprises two releasing buttons for releasing said releasable locker from said locker slot, each of said releasing buttons having a pushing end aligned with said respective resilient arm and an opposed pressing end arranged in such a manner that when said pressing ends of said releasing buttons are pressed, said pushing ends of said releasing buttons push at said resilient arms towards said resilient gaps so as to disengage said hooking ends of said resilient arms with said locking protrusions respectively.

7. The outdoor umbrella, as recited in claim 6, wherein said two releasing buttons are slidably mounted at said sidewalls of said locker slot respectively at a position that said pushing ends of said releasing buttons are align with said hooking ends of said resilient arms respectively, such that when said pressing ends of said releasing buttons are pressed, said resilient arms are driven to move at said resilient gaps to disengage with said locking protrusions respectively.

8. The outdoor umbrella, as recited in claim 7, wherein said locking arrangement further comprises two resilient elements supported within said resilient gaps respectively, wherein each of said resilient elements has two ends biasing against said respective resilient arm and said sidewall of said locking tongue for applying an urging force against said resilient arm.

9. The outdoor umbrella, as recited in claim 6, wherein said locking arrangement further comprises two resilient elements supported within said resilient gaps respectively, wherein each of said resilient elements has two ends biasing against said respective resilient arm and said sidewall of said locking tongue for applying an urging force against said resilient arm.

10. The outdoor umbrella, as recited in claim 6, wherein said pushing ends of said two releasing buttons are sidewardly extended at said resilient arms respectively such that when said pressing ends of said releasing buttons are pressed, said resilient arms are driven to move at said resilient gaps to disengage with said locking protrusions respectively.

11. The outdoor umbrella, as recited in claim 10, wherein said locker slot further has two actuation slots formed at said sidewalls respectively, wherein said pressing ends of said releasing buttons are protruded out of said locker slot through said actuation slots respectively when said releasable locker is locked at said locker slot.

12. The outdoor umbrella, as recited in claim 6, wherein said pushing ends of said two releasing buttons are slidably mounted at said resilient arms respectively such that when said pressing ends of said releasing buttons are pressed to slide along said resilient arms respectively, said resilient arms are driven to move at said resilient gaps to disengage with said locking protrusions respectively.

13. The outdoor umbrella, as recited in claim 12, wherein said locker slot further has two actuation slots formed at said sidewalls respectively, wherein said pressing ends of said releasing buttons are protruded out of said locker slot through said actuation slots respectively when said releasable locker is locked at said locker slot.

14. The outdoor umbrella, as recited in claim 3, wherein said locking arrangement further comprises two releasing buttons for releasing said releasable locker from said locker slot, each of said releasing buttons having a pushing end aligned with said respective resilient arm and an opposed pressing end arranged in such a manner that when said pressing ends of said releasing buttons are pressed, said pushing ends of said releasing buttons push at said resilient arms towards said resilient gaps so as to disengage said hooking ends of said resilient arms with said locking protrusions respectively.

15. The outdoor umbrella, as recited in claim 14, wherein said two releasing buttons are slidably mounted at said sidewalls of said locker slot respectively at a position that said pushing ends of said releasing buttons are align with said hooking ends of said resilient arms respectively, such that when said pressing ends of said releasing buttons are pressed, said resilient arms are driven to move at said resilient gaps to disengage with said locking protrusions respectively.

16. The outdoor umbrella, as recited in claim 14, wherein said pushing ends of said two releasing buttons are sidewardly extended from said resilient arms respectively such that when said pressing ends of said releasing buttons are pressed, said resilient arms are driven to move at said resilient gaps to disengage with said locking protrusions respectively.

17. The outdoor umbrella, as recited in claim 16, wherein said locker slot further has two actuation slots formed at said sidewalls respectively, wherein said pressing ends of said releasing buttons are protruded out of said locker slot through said actuation slots respectively when said releasable locker is locked at said locker slot.

18. The outdoor umbrella, as recited in claim 14, wherein said pushing ends of said two releasing buttons are slidably mounted at said resilient arms respectively such that when said pressing ends of said releasing buttons are pressed to slide along said resilient arms respectively, said resilient arms are driven to move at said resilient gaps to disengage with said locking protrusions respectively.

19. The outdoor umbrella, as recited in claim 1, wherein said housing is an operation housing mounted at said supporting shaft, an said umbrella frame further comprises operational unit received at said operation housing for selectively operating said awning frame at an unfolded position and a folded position, and a battery compartment provided at a sidewall of said operation housing to receive said rechargeable battery unit, wherein said locker slot and said electrical terminal are provided at a base wall and a bottom wall of said battery compartment to slidably engage with said releasable locker and to electrically contact with said battery terminal respectively when said rechargeable battery unit is received in said battery compartment.

20. The outdoor umbrella, as recited in claim 19, wherein said releasable locker contains a mounting slot aligned with said locker slot when said rechargeable battery unit is disposed in said battery compartment and comprises a mounting screw detachably engaging with said locker slot through said mounting slot to detachably mount said rechargeable battery unit to said battery compartment.

* * * * *